US008602160B2

(12) United States Patent
Koneval

(10) Patent No.: US 8,602,160 B2
(45) Date of Patent: Dec. 10, 2013

(54) SAFETY ANCHOR

(75) Inventor: Stephen P. Koneval, Beloit, OH (US)

(73) Assignee: RBI Acquisition Company, Youngstown, OH (US)

( * ) Notice: Subject to any disclaimer, the term of this patent is extended or adjusted under 35 U.S.C. 154(b) by 474 days.

(21) Appl. No.: 12/873,528

(22) Filed: Sep. 1, 2010

(65) Prior Publication Data

US 2011/0048851 A1 Mar. 3, 2011

Related U.S. Application Data

(60) Provisional application No. 61/239,490, filed on Sep. 3, 2009.

(51) Int. Cl.
*A62B 35/00* (2006.01)

(52) U.S. Cl.
USPC ..... 182/3

(58) Field of Classification Search
USPC ..... 182/45, 3; 248/231.9, 231.91
See application file for complete search history.

(56) References Cited

U.S. PATENT DOCUMENTS 3,263,629 A * 8/1966 Higuchi ..... 410/105
4,472,088 A * 9/1984 Martin ..... 405/259.3
4,896,416 A * 1/1990 Cranko et al. ..... 29/522.1
5,535,694 A 7/1996 Czipri
6,715,238 B2 * 4/2004 Zambelli et al. ..... 52/24
6,834,745 B2 * 12/2004 Vandelinde ..... 182/3
2002/0098054 A1 7/2002 Guthrie et al.
2006/0022101 A1 2/2006 Reeves

FOREIGN PATENT DOCUMENTS

CA 2060701 8/1992
GB 2387874 10/2003

OTHER PUBLICATIONS

International Search Report and Written Opinion mailed Dec. 8, 2010 for Application No. PCT/US2010/047476.
International Preliminary Report on Patentability mailed on Mar. 15, 2012 for PCT Application No. PCT/US2010/047476.

* cited by examiner

*Primary Examiner* — Katherine Mitchell
*Assistant Examiner* — Kristine Florio
(74) *Attorney, Agent, or Firm* — Carlson, Gaskey & Olds, P.C.

(57) ABSTRACT

A safety anchor is removably attachable to a roof of a building. The safety anchor includes a portion receivable in a drain line of the roof. The safety anchor also includes a stem received in openings of the portion and an elastic member attached to the stem. The elastic member has an adjustable diameter, and the diameter of the elastic member is increased to contact walls of the drain line to secure the safety anchor to the roof.

27 Claims, 8 Drawing Sheets

SAFETY ANCHOR

REFERENCE TO RELATED APPLICATION

This application claim priority to U.S. Provisional Patent Application Ser. No. 61/239,490 filed Sep. 3, 2009.

BACKGROUND OF THE INVENTION

This invention relates generally to a safety anchor that is removably attachable to a building to restrain a worker when working on a roof of the building.

When repairing or constructing a roof, workers can be working at heights that are far from the ground. There is a need for a system that retains workers when working on roofs of buildings.

SUMMARY OF THE INVENTION

A safety anchor is removably attachable to a roof of a building. The safety anchor includes a portion receivable in a drain line of the roof. The safety anchor also includes a stem received in openings of the portion and an elastic member attached to the stem. The elastic member has an adjustable diameter, and the diameter of the elastic member is increased to contact walls of the drain line to secure the safety anchor to the roof.

In another exemplary embodiment, a safety system includes a safety anchor removably attachable to a roof of a building including a first portion connected to a second portion and a third portion connected to a second portion. The first portion, the second portion and the third portion are moveable relative to each other. At least one of the first portion, the second portion, and the third portion is receivable in a drain line of the roof. The first portion has a first diameter, the second portion has a second diameter, and the third portion has a third diameter. The first diameter is greater than the second diameter, and the second diameter is greater than the third diameter. The safety anchor also includes a threaded stem received in openings of the first portion, the second portion and the third portion, and an elastic member is attached to the threaded stem. The elastic member has an adjustable diameter, and the diameter of the elastic member is increased to contact walls of the drain line to secure the safety anchor to the roof.

These and other features of the present invention will be best understood from the following specification and drawings.

DETAILED DESCRIPTION OF THE DRAWINGS

The various features and advantages of the invention will become apparent to those skilled in the art from the following detailed description of the currently preferred embodiment. The drawings that accompany the detailed description can be briefly described as follows:

DETAILED DESCRIPTION OF THE PREFERRED EMBODIMENT

Figure 1:
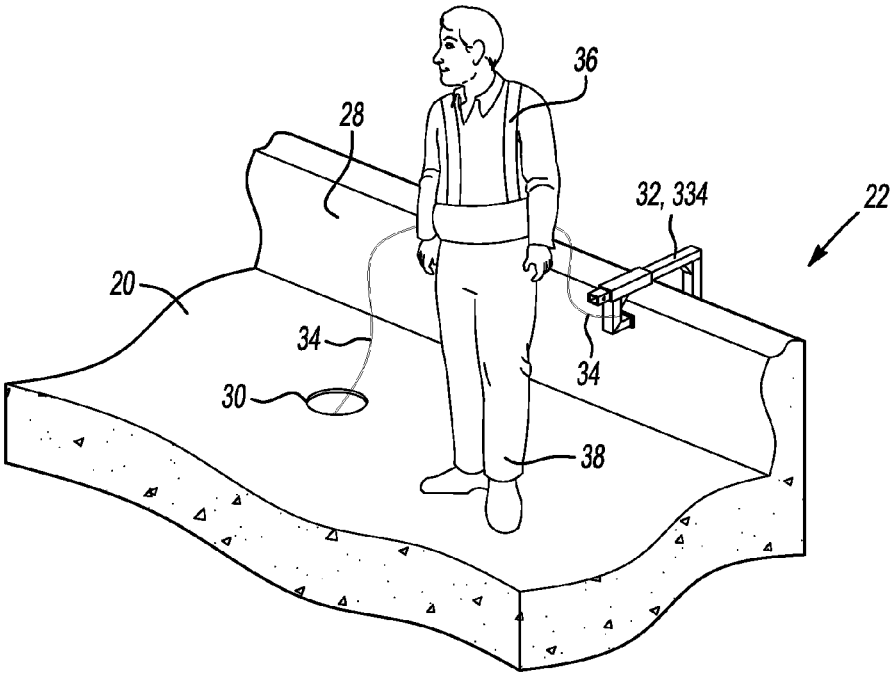
FIG. 1 illustrates a perspective view of a roof of a building.

FIG. 1 illustrates a roof 20 of a building 22. The roof 20 includes a drain basket 24 that cover a drain bowl 26 (shown in FIG. 2) and a parapet wall 28 that surrounds a perimeter of the building 22. In one example, the drain bowl 26 has a diameter of 12" to 18". As described below, a safety anchor (such as a drain insert 30 or a wall bracket 32 or 334) is secured to the building 22. In one example shown in FIGS. 2 to 9, the drain insert 30 is received in a drain bowl 26. In another example shown in FIGS. 10 to 18, the wall bracket 32 or 334 is secured to the parapet wall 28. One end of a shock absorbing lanyard 34 is connected to the drain insert 30 or an eye bolt 236 or 336 (described below) of the wall bracket 32 and 334 by a carry ring (or D-ring) 100, and another end of the lanyard 34 is attached to a harness 36 (shown schematically) that is worn by a worker 38. Although both the drain insert 30 and the wall brackets 32 and 334 are shown in FIG. 1, only one of the drain insert 30 of the wall bracket 32 and 334 is used at a time.

Figure 2:
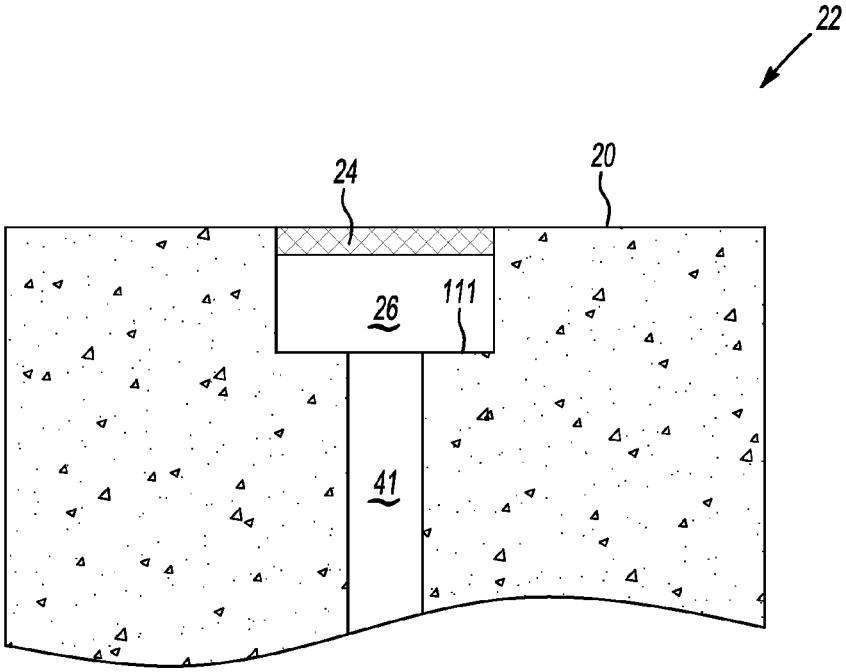
FIG. 2 illustrates a cross-sectional view of the building.

FIG. 2 illustrates a cross-sectional view of the building 22. The drain basket 24 covers the drain bowl 26, which is in fluid communication with a drain line 41 that drains fluid or water from the roof 20 of the building 22. The drain bowl 26 includes a bottom surface 111. In one example, the drain line 41 is made of PVC or cast iron. In one example, the drain line 41 has a diameter of 3", 4" or 6". The drain basket 24 is removable to expose the drain bowl 26.

Figure 3:
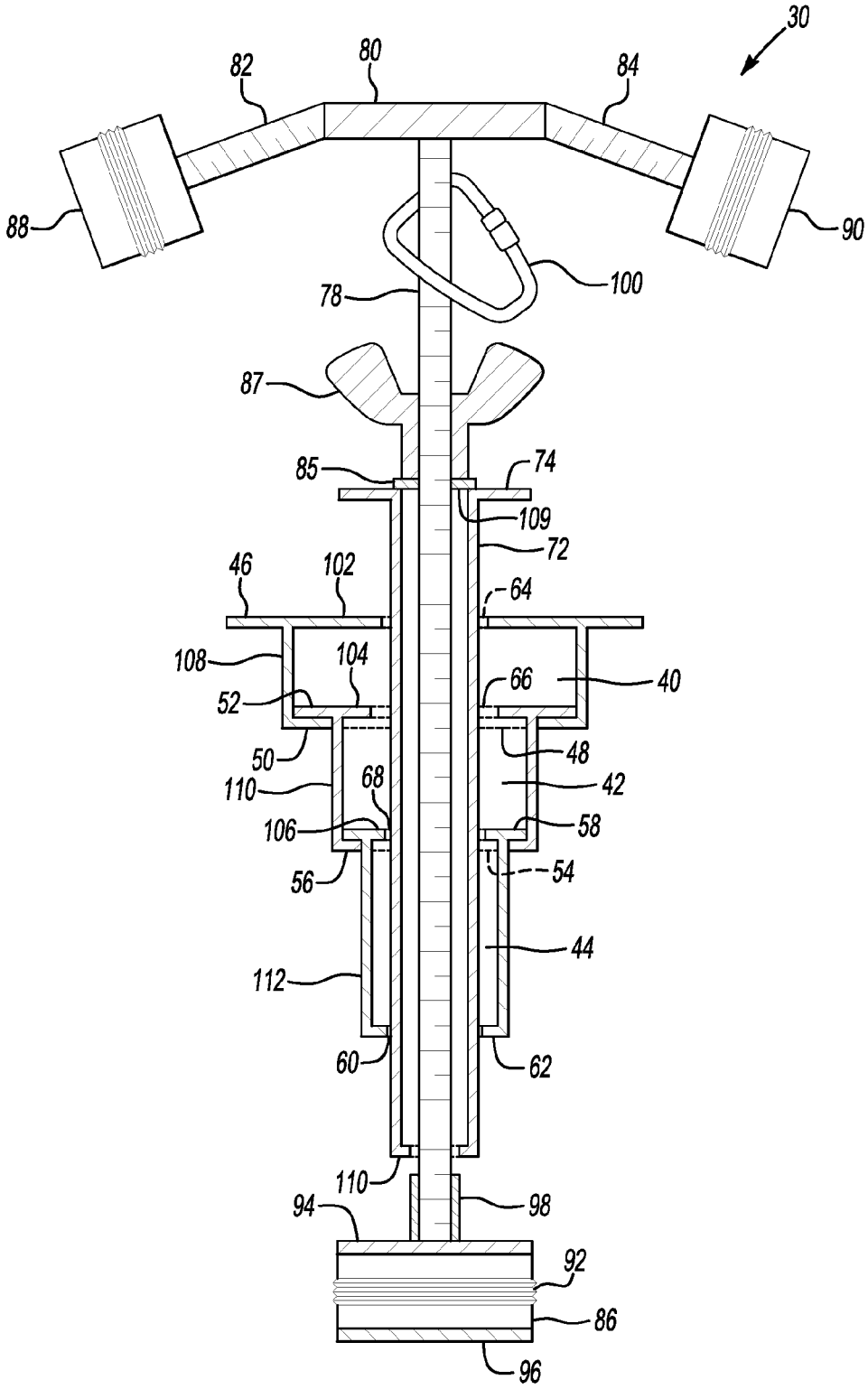
FIG. 3 illustrates a cross-sectional view of a drain insert as a first example drain anchor in a fully extended position.

FIG. 3 illustrates a first example safety anchor, which in this embodiment is a drain insert 30. In one example, the drain insert 30 can sustain 200 pounds of weight to meet OSHA fall prevention guidelines. The drain insert 30 has a compact position, a partially extended position, and a fully extended position. The drain insert 30 is shown in a fully extended position. In one example, the drain insert 30 is made of aluminum.

The drain insert 30 includes three hollow portions 40, 42 and 44. A large portion 40 is designed to fit in a drain line 41 having a 6" diameter, a medium portion 42 is designed to fit in a drain line 41 having a 4" diameter, and a small portion 44 is designed to fit in a drain line 41 having a 3" diameter. The portions 40, 42 and 44 telescope relative to each other. In the FIG. 3 example, the drain insert 30 is used with a 6" or 4" drain line 41. As FIG. 3 shows a cross-sectional view, the dotted lines represent the portion of the components that are not located at the exact plane of the cross-section.

Figure 4A:
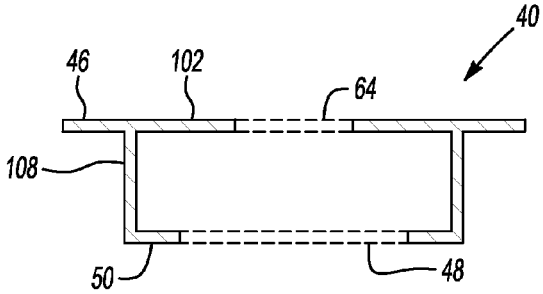
FIG. 4A illustrates a cross-sectional view of a large portion of the drain insert.

As shown in FIG. 4A, the large portion 40 includes a cylindrical body 108, an outwardly extending projection 46 that extends outwardly from a circumference of a top surface of the cylindrical body 108, an inwardly extending projection 102 that extends inwardly from the top surface of the cylindrical body 108, and an inwardly extending projection 50 that extends inwardly from a bottom surface of the cylindrical body 108. The inwardly extending projection 102 defines an opening 64, and the inwardly extending projection 50 defines an opening 48.

Figure 4B:
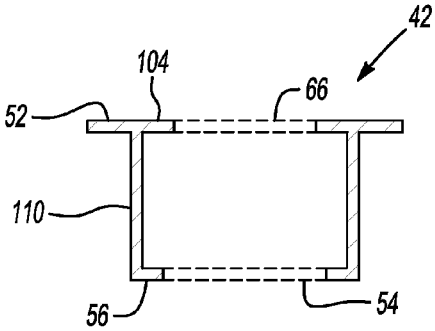
FIG. 4B illustrates a cross-sectional view of a medium portion of the drain insert.

As shown in FIG. 4B, the medium portion 42 includes a cylindrical body 110, an outwardly extending projection 52 that extends outwardly from a circumference of a top surface of the cylindrical body 110, an inwardly extending projection 104 that extends inwardly from the top surface of the cylindrical body 110, and an inwardly extending projection 56 that extends inwardly from a bottom surface of the cylindrical body 110. The inwardly extending projection 104 defines an opening 66, and the inwardly extending projection 56 defines an opening 54.

Figure 4C:
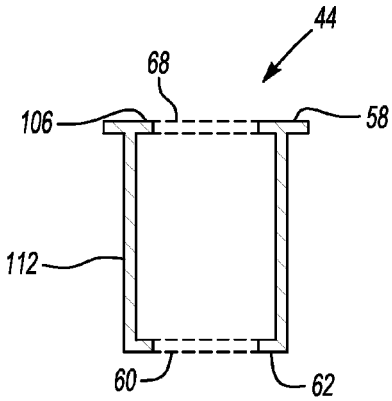
FIG. 4C illustrates a cross-sectional view of a small portion of the drain insert.

As shown in FIG. 4C, the small portion 44 includes a cylindrical body 112, an outwardly extending projection 58 that extends outwardly from a circumference of a top surface of the cylindrical body 112, an inwardly extending projection 106 that extends inwardly from the top surface of the cylindrical body 112, and an inwardly extending projection 62 that extends inwardly from a bottom surface of the cylindrical body 112. The inwardly extending projection 106 defines an opening 68, and the inwardly extending projection 62 defines an opening 60.

As shown in FIG. 3, the portions 40, 42 and 44 are arranged such that the outwardly extending projection 58 of the small portion 44 is received within a hollow interior of the medium portion 42, and the outwardly extending projection 52 of the medium portion 42 is received within a hollow interior of the large portion 40.

A diameter of the opening 54 of the medium portion 42 is large enough to allow the cylindrical body 112 of the small portion 44 to be received within and slide within the opening 54. However, the engagement of the outwardly extending projection 58 of the small portion 44 and the inwardly extending projection 56 of the medium portion 42 prevents the portions 42 and 44 from separating.

A diameter of the opening 48 of the large portion 40 is large enough to allow the cylindrical body 110 of the medium portion 42 to be received within and slide within the opening 48. However, the engagement of the outwardly extending projection 52 of the medium portion 42 and the inwardly extending projection 50 of the large portion 40 prevents the portions 40 and 42 from separating.

Figure 5:
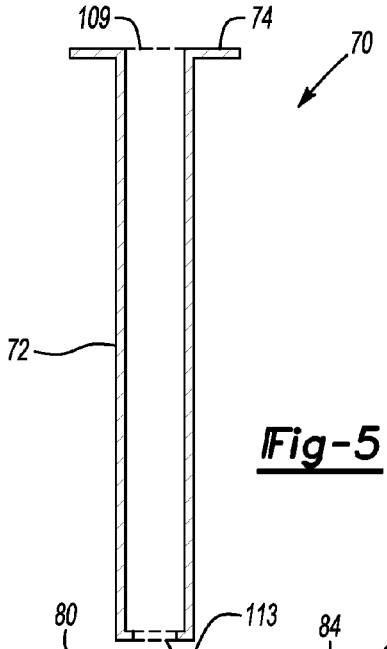
FIG. 5 illustrates a cross-sectional view of a pipe.

As shown in FIG. 5, the drain insert 30 also includes a pipe 70 that is received through the aligned openings 48, 54, 60 64, 66 and 68. In one example, the pipe 70 has a substantially circular cross-section. The pipe 70 includes a cylindrical body 72 and an outwardly extending projection 74 that extends around an upper circumference of an upper end of the cylindrical body 72 to define an opening 109. The cylindrical body 72 defines an opening 113 at a lower end. In one example, the pipe 70 is made of aluminum. The pipe 70 is received in the aligned openings 48, 54, 60 64, 66 and 68.

Figure 6:
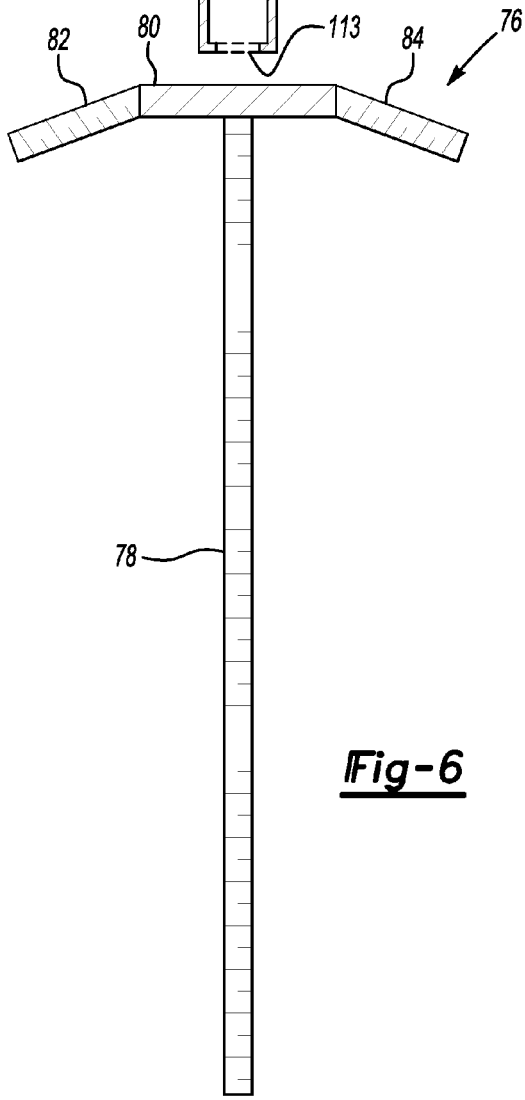
FIG. 6 illustrates a cross-sectional view of an all-thread center post.

As shown in FIG. 6, the drain insert 30 also includes an all-thread center post 76. In one example, the all-thread center post 76 is 100% threaded. In one example, the all-thread center post 76 is made of stainless steel. The all-thread center post 76 includes a threaded stem 78 and a carry bar 80 attached to an upper end of the threaded stem 78. The carry bar 80 includes two threaded projections 82 and 84. The threaded stem 78 is received in the aligned openings 48, 54, 60 64, 66, 68, 109 and 110.

Returning to FIG. 3, a washer 85 is located above the outwardly extending projection 74. A wing-nut handle 87 is located on the threaded stem 78 between the washer 85 and the carry bar 80.

Returning to FIG. 3, a plumber's plug 86, or rubber gasket, is internally threaded and removably connected to a bottom end of the threaded stem 78. The drain insert 30 includes three plumber's plugs 86, 88 and 90 each including an annular projection 92 around a center portion of each of the plumber's plug 86, 88 and 90. A first plumber's plug 86 is used with the 6" drain line 41, a second plumber's plug 88 is used with the 4" drain line 41, and a third plumber's plug 90 is used with the 3" drain line 41. In the illustrated example of FIG. 3, the plumber's plug 86 is attached to the bottom end of the threaded stem 78. The other two plumber's plug 88 and 90 are each threaded on one of the two threaded projections 82 and 84, respectively, of the carry bar 80. The plumber's plugs 86, 88 and 90 can be moved between the bottom end of the threaded stem 78 and the projections 82 and 84 of the carry bar 80 based on the diameter of the drain line 41.

The plumber's plug 86 located at the bottom end of the threaded stem 78 is located between two flat discs 94 and 96. In one example, the flat disc 94 and 96 are made of steel. The top flat disc 94 is located above the plumber's plug 86 under a spring pin 98 that is located under the pipe 70, and the bottom flat disc 96 is located below the plumber's plug 86. The bottom flat disc 96 is fixed to the bottom end of the threaded stem 78, and the top flat disc 94 is not fixed to the threaded stem 78. When the wing-nut handle 87 is rotated, the threaded stem 78 is rotated by turning the wing-nut handle 87. The bottom flat disc 96 rotates and moves upwardly towards the top flat disc 94. This force compresses the plumber's plug 86, causing the plumber's plug 86 to expand in diameter. The wing-nut handle 87 can be turned into the opposite direction to lower the bottom flat disc 96 relative to the top flat disc 94, removing the pressure and causing the plumber's plug 86 to reduce in diameter.

As the drain insert 30 is lifted, gravity causes the small portion 44 to telescope downwardly relative to the medium portion 42. The small portion 44 does not separate from the medium portion 42 due to the engagement of the outwardly extending projection 58 of the small portion 44 and the inwardly extending projection 56 of the medium portion 42. As the drain insert 30 is lifted more, gravity causes the medium portion 42 to telescope downwardly relative to the large portion 40. The medium portion 42 does not separate from the large portion 40 due to the engagement of the outwardly extending projection 52 of the medium portion 42 and the inwardly extending projection 50 of the large portion 40. The drain insert 30 is then in the extended position.

When the drain insert 30 is to be used, the drain basket 24 is removed, exposing the drain bowl 26. The plumber's plug that corresponds to the size of the drain line 41 is attached to the lower end of the threaded stem 78. The drain insert 30 is positioned over the drain bowl 26 and lowered into the drain bowl 26.

Figure 7:
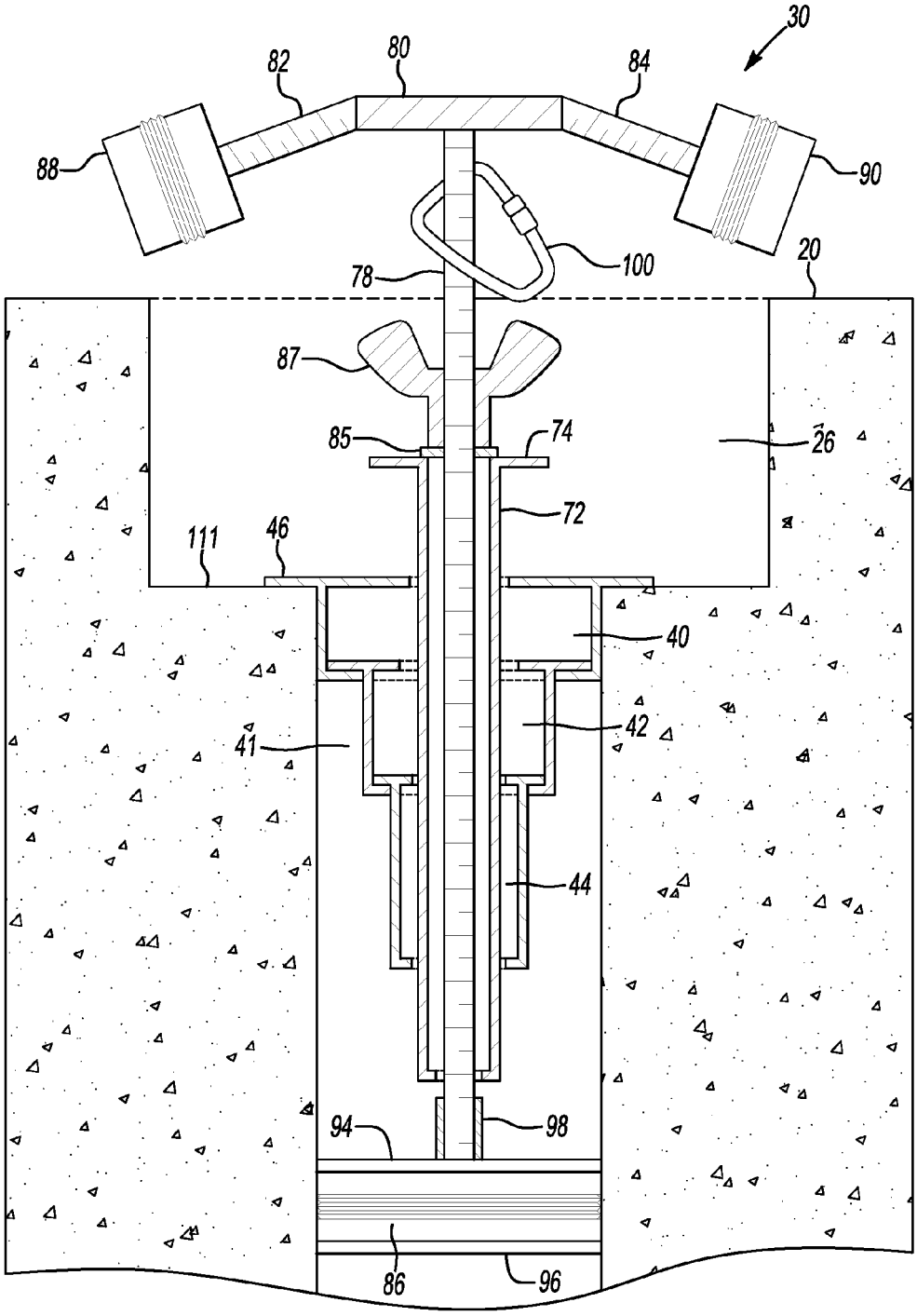
FIG. 7 illustrates a cross-sectional view of the drain insert when used with a 6" drain line.

FIG. 7 shows the drain insert 30 received in a 6" drain line 41. The plumber's plug 86 is secured to the bottom of the threaded stem 78. The small portion 44, the medium portion 42 and the large portion 40 have a diameter smaller than the diameter of the drain line 41, and the portions 40, 42 and 44 can enter the drain line 41, and the drain insert 30 is in the extended position. The outwardly extending projection 46 of the large portion 40 is larger than the diameter of the 6" drain line 41, preventing the drain insert 30 from falling through the drain line 41. The outwardly extending portion 46 of the large portion 40 rests against and contacts the bottom surface 111 of the drain bowl 26. In this position, the drain insert 30 is in the fully extended position. The wing-nut handle 87 is then turned to compress the plumber's plug 86 between the flat disks 94 and 96, extending the diameter of the plumber's plug 86 and expanding the plumber's plug 86 against the wall of the drain line 41, securing the drain insert 30 in the drain line 41.

Figure 8:
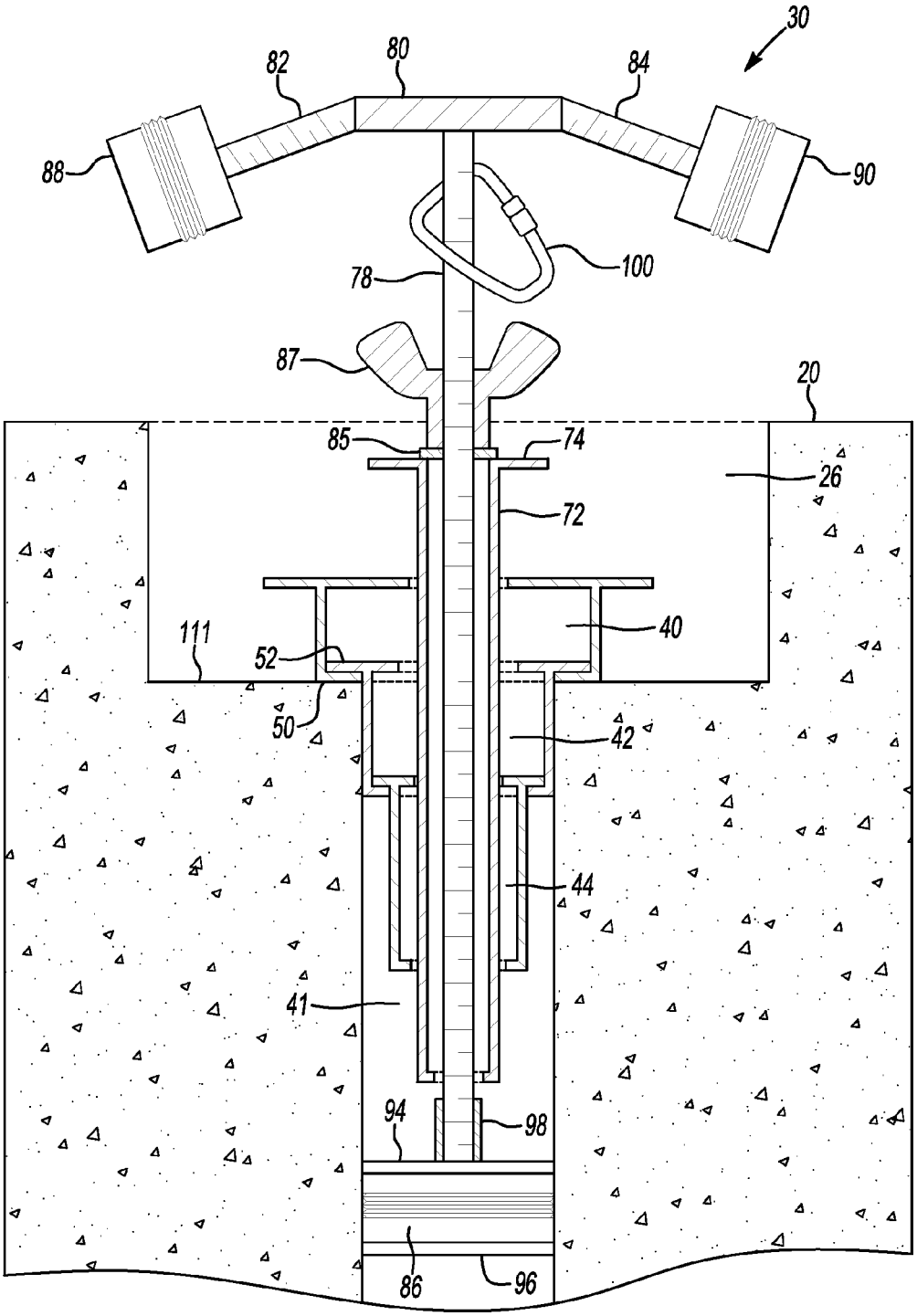
FIG. 8 illustrates a cross-sectional view of the drain insert when used with a 4" drain line.

FIG. 8 shows the drain insert 30 received in a 4" drain line 41 in a partially extended position. The plumber's plug 88 is secured to the bottom of the threaded stem 78. The small portion 44 and the medium portion 42 have a diameter smaller than the diameter of the drain line 41, and the portions 42 and 44 can enter the drain line 41; the large portion 40 is located in the drain bowl 26. The projections 50 and 52 are larger than the diameter of the 4" drain line 41, preventing the drain insert 30 from falling through the drain line 41. The inwardly extending portion 50 of the large portion 40 rests against and contacts the bottom surface 111 of the drain bowl 26. In this position, the drain insert 30 is in the fully extended position. The wing-nut handle 87 is then turned to compress the plumber's plug 88 between the flat disks 94 and 96, extending the diameter of the plumber's plug 88 and expanding the plumber's plug 88 against the wall of the drain line 41, securing the drain insert 30 in the drain line 41.

Figure 9:
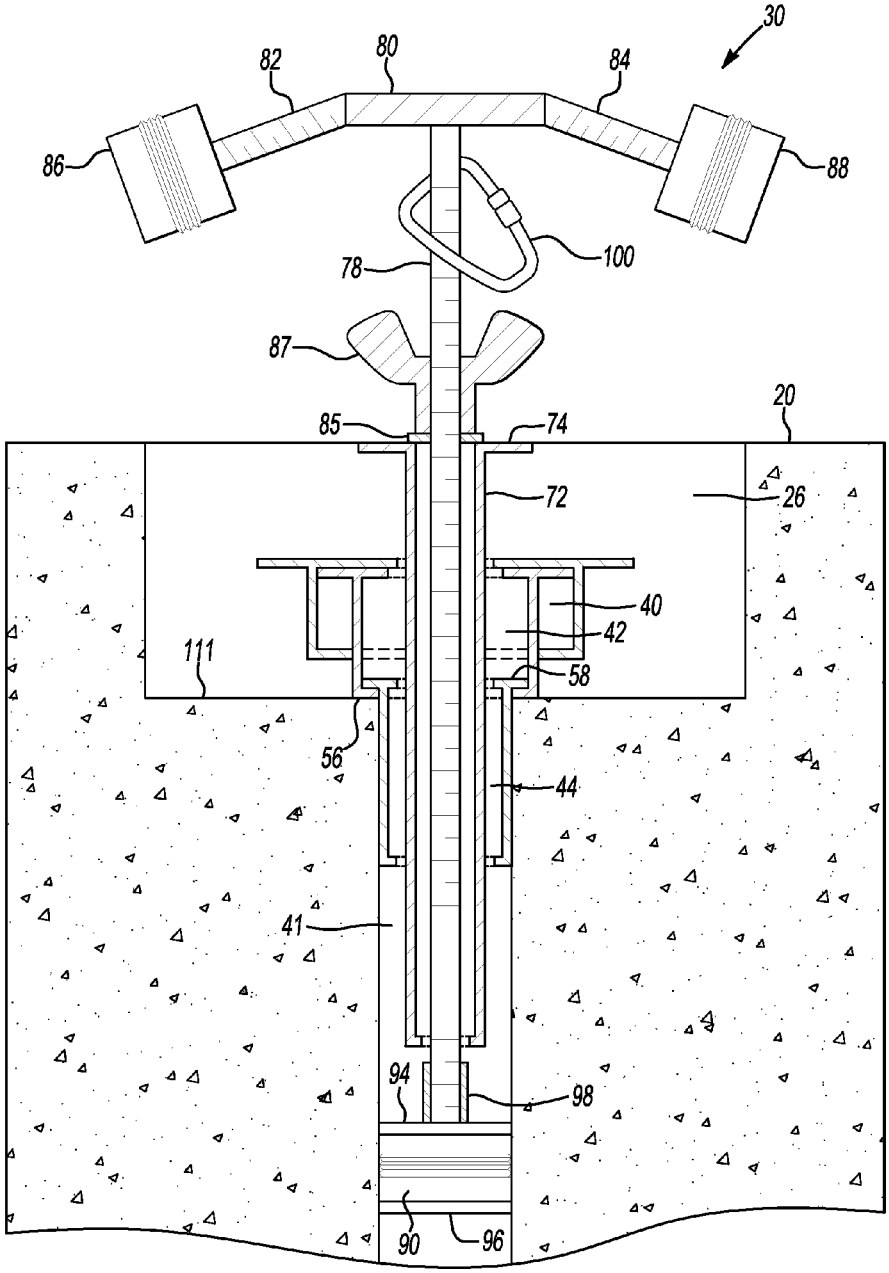
FIG. 9 illustrates a cross-sectional view of the drain insert when used with a 3" drain line.

FIG. 9 shows the drain insert 30 received in a 3" drain line 41. The plumber's plug 90 is secured to the bottom of the threaded stem 78. The small portion 44 has a diameter smaller than the diameter of the drain line 41, and only the small portion 44 enters the drain line 41. The medium portion 42 is biased into the hollow space of the large portion 40 and located in the drain bowl 26. The projections 56 and 58 are larger than the diameter of the 3" drain line 41, preventing the drain insert 30 from falling through the drain line 41. The inwardly extending portion 56 of the medium portion 42 rests against and contacts the bottom surface 111 of the drain bowl 26. In this position, the drain insert 30 is partially contracted. The wing-nut handle 87 is then turned to compress the plumber's plug 90 between the flat disks 94 and 96, extending the diameter of the plumber's plug 90 and expanding the plumber's plug 90 against the wall of the drain line 41, securing the drain insert 30 in the drain line 41.

Once the drain insert 30 is secured in the drain line 41, a carry ring 100 is secured to the threaded stem 78 or the pipe 70. The carry ring 100 is located at one end of the lanyard 34, and the other end of the lanyard 34 is attached to a harness 36 that is worn by the worker 38 to restrain the worker 38.

Figure 10:
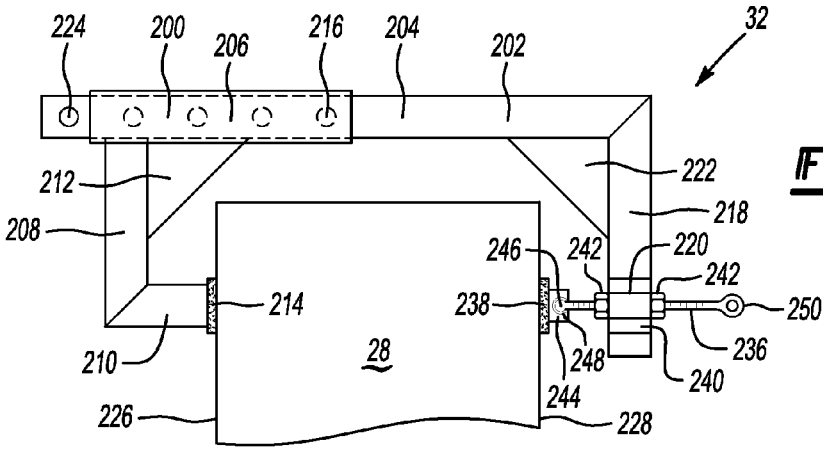
FIG. 10 illustrates a wall bracket as a second example safety anchor.

FIG. 10 illustrates a second example safety anchor. The safety anchor is a wall bracket 32. In one example, the wall bracket 32 can sustain 200 pounds of weight to meet the OSHA fall prevention guidelines. The wall bracket 32 includes a first portion 200 and a second portion 202. In one example, the first portion 200 and the second portion 202 are made of aluminum. The second portion 202 includes an insertable arm 204 that is receivable in a hollow receiving tube 206 of the first portion 200. In one example, the insertable arm 204 has a substantially circular cross-section, and the receiving tube 206 has a substantially square cross-section.

Figure 11:
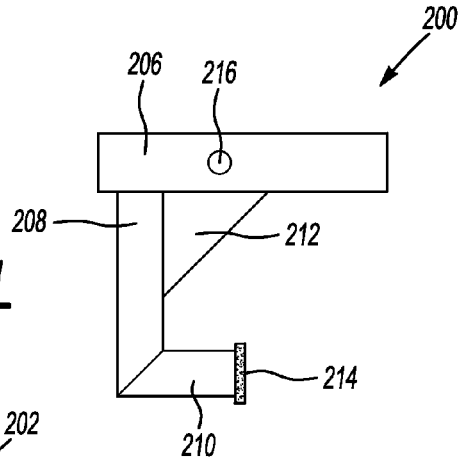
FIG. 11 illustrates a first portion of the wall bracket.

As shown in FIG. 11, the first portion 200 includes the receiving tube 206, a connecting arm 208 that is substantially perpendicular to the receiving tube 206, and a pressure arm 210 that is substantially perpendicular to the connecting arm 208 and substantially parallel to the receiving tube 206. The receiving tube 206 includes an aperture 216. A gusset 212 is provided at the intersection of the receiving tube 206 and the connecting arm 208 to provide support. The pressure arm 210 is shorter than the receiving tube 206, and a rubber pad 214 is positioned at an end of the pressure arm 210.

Figure 12:
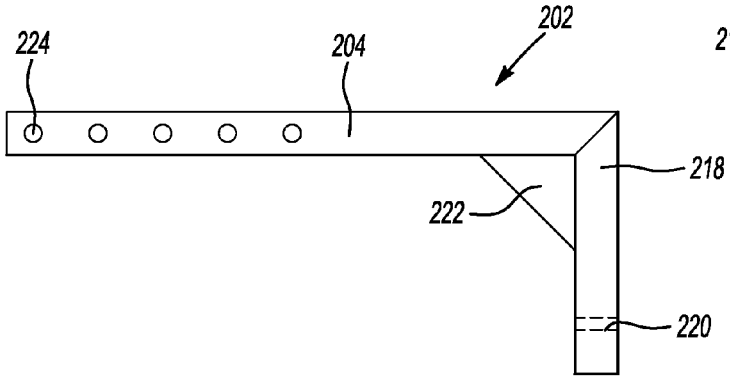
FIG. 12 illustrates a second portion of the wall bracket.
Figure 13:
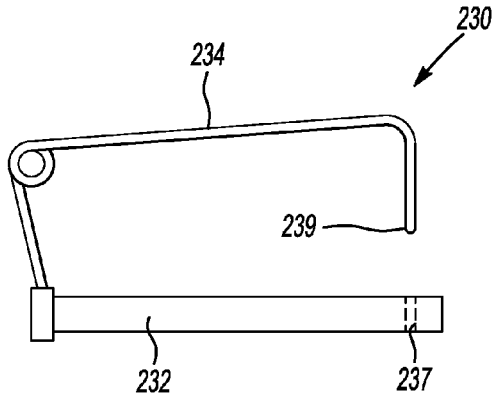
FIG. 13 illustrates a safety clasp.

As shown in FIG. 12, the second portion 202 includes an arm 218 that is substantially perpendicular to the insertable arm 204. The arm 218 includes an aperture 220, as described below. A gusset 222 is provided at the intersection of the insertable arm 204 and the arm 218 to provide support. The insertable arm 204 includes a plurality of apertures 224.

In use, returning to FIG. 10, the wall bracket 32 is positioned such that the first portion 200 is located on an outside wall 226 of the parapet wall 28, and the second portion 202 is located on an inside wall 228 of the parapet wall 28. The insertable arm 204 is received in a hollow interior of the receiving tube 206. The rubber pad 214 is positioned on the outside wall of the parapet wall 28. A threaded eye bolt 236 is received in the aperture 220 of the second portion 202, and the threaded eye bolt 236 is turned in a first direction to position a rubber pad 214 attached to the threaded eye bolt 236 against the inside wall 228 of the parapet wall 28.

The aperture 216 of the first portion 200 is aligned with one of the apertures 224 of the second portion 202, and a safety clasp 230 (shown in FIG. 13) is received in the aligned apertures 216 and 220. The safety clasp 230 includes a pin 232 having a groove 237 and a clasp 234 including a hook 239. Once the pin 232 is received in the aligned apertures 216 and 220, the hook 239 is received in the groove 237, securing the safety clasp 230 in position.

The alignment of the apertures 216 and 220 provides for rough alignment of the wall bracket 32. Returning to FIG. 10, the threaded eye bolt 236 provides for fine adjustment of the wall bracket 32. A stainless steel band 240 is located around the portion of the arm 218 that includes the aperture 220. A nut 242 is positioned on each side of the aperture 220. The threaded eye bolt 236 includes a ball fit 246 at an end of the threaded eye bolt 236. The threaded eye bolt 236 is received in an aperture 248 of a swivel portion 244, and the ball fit 246 is received within the swivel portion 244. The rubber pad 238 is located on the swivel portion 244. The swivel portion 244 can swivel relative to the threaded eye bolt 236 to accommodate for any unevenness in the surface of the parapet wall 28. A looped end 250 of the threaded eye bolt 236 is rotated to move the rubber pad 238 towards the parapet wall 28 to provide for fine adjustment of the wall bracket 32.

Once the wall bracket 32 has been adjusted, the rubber pads 214 and 238 are positioned against the respective wall 226 and 228, securing the wall bracket 32 to the parapet wall 28. The force or pull is directly horizontal from an inside contact point of the eye bolt 236 to the inside wall 228 to an outside contact point of the rubber pad 214 to the outside wall 226, ensuring that the wall bracket 32 does not slide or pivot away from the parapet wall 28 when a force is applied to the wall bracket 32.

In use, the carry ring 100 attached to a lanyard 34 is attached to the looped end 250 of the threaded eye bolt 236. The lanyard 34 is attached to a harness 36 worn by a worker 38 to restrain the worker 38.

To remove the wall bracket 32, the threaded eye bolt 236 is loosened and turned in an opposing second direction, removing the force of the rubber pad 238 against the inside wall 228 of the parapet wall 28. The safety clasp 230 can then be removed to allow the first portion 200 and the second portion 202 to separate and be removed from the parapet wall 28.

Figure 14:
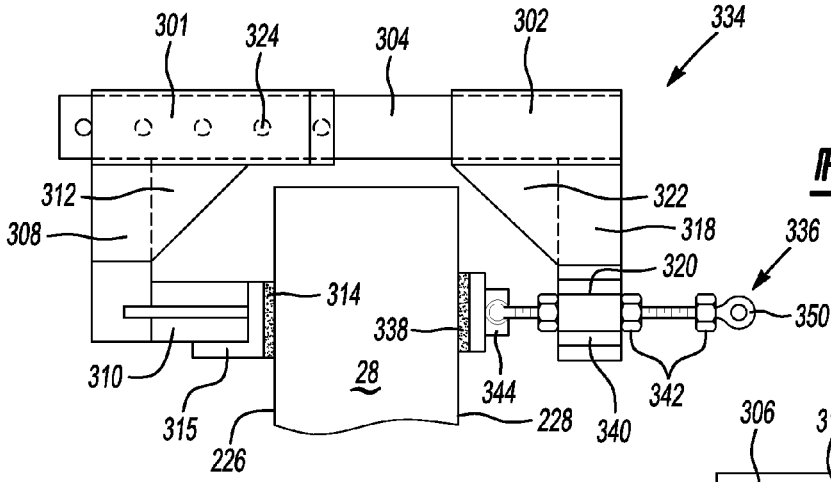
FIG. 14 illustrates a wall bracket as a third example safety anchor.

FIG. 14 illustrates a third example safety anchor. The safety anchor is a wall bracket 334. In one example, the wall bracket 334 can sustain 5000 pounds of weight to meet the OSHA fall arrest guidelines. The wall bracket 334 includes a first portion 301 and a second portion 302. In one example, the first portion 301 and the second portion 302 are made of aluminum. The second portion 302 includes an insertable arm 304 that is receivable in a hollow receiving tube 306 of the first portion 301. In one example, the insertable arm 304 and the receiving tube 306 have a substantially square cross-section.

Figure 15:
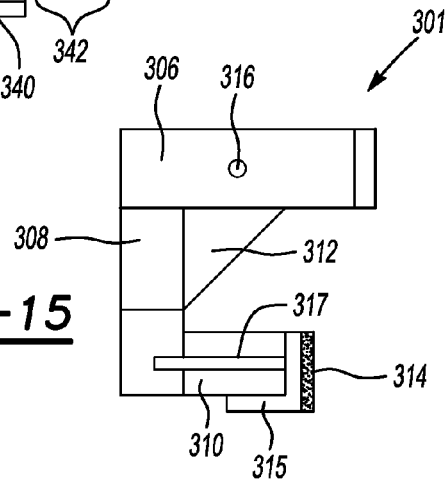
FIG. 15 illustrates a first portion of the wall bracket.

As shown in FIG. 15, the first portion 301 includes the receiving tube 306, a connecting arm 308 that is substantially perpendicular to the receiving tube 306, and a pressure arm 310 that is substantially perpendicular to the connecting arm 308 and substantially parallel to the receiving tube 306. The receiving tube 306 includes an aperture 316. A gusset 312 is provided at the intersection of the receiving tube 306 and the connecting arm 308 to provide support. The gusset 312 extends the width of the wall bracket 334. That is, the gusset 312 has a width that is approximately equal to the width of the connecting arm 308. The pressure arm 310 is shorter than the receiving tube 306, and a rubber pad 314 is positioned at an end of a horizontal planar portion 315 on an end of the pressure arm 310. A gusset 317 is attached at the intersection of the pressure arm 310 and the horizontal planar portion 315.

Figure 16:
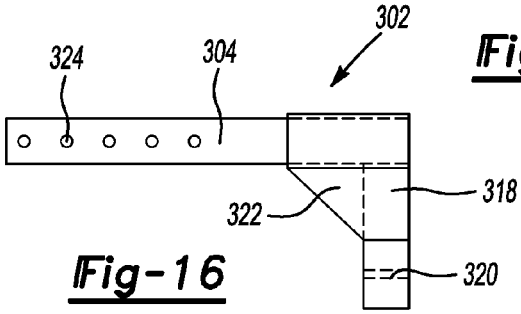
FIG. 16 illustrates a second portion of the wall bracket.
Figure 18:
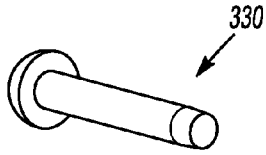
FIG. 18 illustrates a hitch pin.
Figure 17:
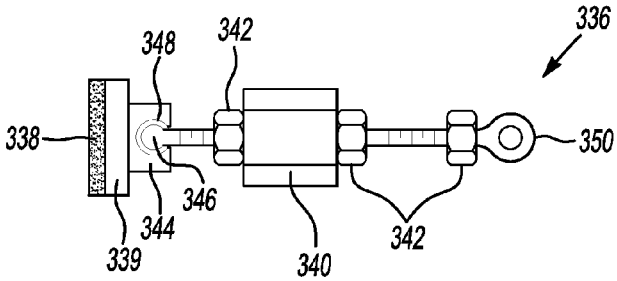
FIG. 17 illustrates a threaded eye bolt.
Figure 19:
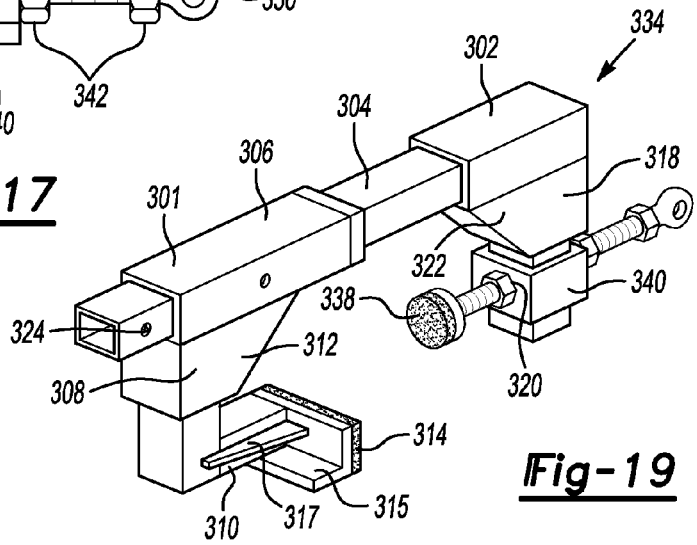
FIG. 19 illustrates a perspective view of the wall bracket.

As shown in FIG. 16, the second portion 302 includes an arm 318 that is substantially perpendicular to the insertable arm 304. The arm 318 includes an aperture 320, as described below. A gusset 322 is provided at the intersection of the insertable arm 304 and the arm 318 to provide support. The gusset 322 extends the width of the wall bracket 334. That is, the gusset 322 has a width that is approximately equal to the width of the arm 318. The insertable arm 304 includes a plurality of apertures 324.

In use, returning to FIG. 14, the wall bracket 334 is positioned such that the first portion 301 is located on an outside wall 226 of the parapet wall 28, and the second portion 302 is located on an inside wall 228 of the parapet wall 28. The insertable arm 304 is received in a hollow interior of the receiving tube 306. The rubber pad 314 is positioned on the outside wall of the parapet wall 28. A threaded eye bolt 336 (shown in FIG. 17) including a rubber pad 338 is received in the aperture 320 of the second portion 302, and the threaded eye bolt 336 is turned in a first direction to position the rubber pad 338 against the inside wall 228 of the parapet wall 28. The rubber pad 338 is positioned on a circular portion 339.

The aperture 316 of the first portion 301 is aligned with one of the apertures 324 of the second portion 302, and a hitch pin 330 (shown in FIG. 18) is received in the aligned apertures 316 and 320.

The alignment of the apertures 316 and 324 provides for rough alignment of the wall bracket 334. Returning to FIG. 17, the threaded eye bolt 336 provides for fine adjustment of the wall bracket 334. A stainless steel band 340 is located around the portion of the arm 318 that includes the aperture 324. A nut 342 is positioned on each side of the aperture 320. The threaded eye bolt 336 includes a ball fit 346 at the end of the threaded eye bolt 336. The threaded eye bolt 336 is received in an aperture 348 of a swivel portion 344, and the ball fit 346 is received within the swivel portion 344. The rubber pad 338 is located on the swivel portion 344. The swivel portion 344 can swivel relative to the threaded eye bolt 336 to accommodate for any unevenness in the surface of the parapet wall 28. A looped end 350 of the threaded eye bolt 336 is rotated to move the rubber pad 338 towards the parapet wall 28 to provide for fine adjustment of the wall bracket 334.

Once the wall bracket 334 has been adjusted, the rubber pads 314 and 338 are positioned against the respective wall 226 and 228, securing the wall bracket 334 to the parapet wall 28. The force or pull is directly horizontal from the inside contact point of the eye bolt 336 to the inside wall 228 to an outside contact point of the rubber pad 314 to an outside wall 226, ensuring that the wall bracket 334 does not side or pivot away from the parapet wall 28 when a force is applied to the wall bracket 334.

In use, the carry ring 100 attached to a lanyard 34 is attached to the looped end 350 of the threaded eye bolt 336. The lanyard 34 is attached to a harness 36 worn by a worker 38 to restrain the worker 38.

To remove the wall bracket 334, the threaded eye bolt 336 is loosened and turned in an opposing second direction, removing the force of the rubber pad 338 against the inside wall 228 of the parapet wall 28. The hitch pin 330 can then be removed to allow the first portion 301 and the second portion 302 to separate and be removed from the parapet wall 28.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A safety anchor removably attachable to a roof of a building, the safety anchor comprising:

a portion receivable in a drain line of a roof, wherein the portion includes three cylindrical portions moveable between a compact position, a partially extended position, and an extended position;

a stem received in an opening of the portion; and an elastic member attached to the stem, the elastic member having an adjustable diameter, wherein the diameter of the elastic member is increased to contact walls of the drain line to secure the safety anchor to the roof.

2. The safety anchor as recited in claim 1 wherein one end of a lanyard is connected to the safety anchor and an opposing end of the lanyard is attached to a harness to be worn by a worker.

3. The safety anchor as recited in claim 1 wherein the three cylindrical portions comprise a first portion and a second portion connected to the first portion, wherein the first portion and the second portion are moveable relative to each other, and at least one of the first portion and the second portion is receivable in the drain line of the roof.

4. The safety anchor as recited in claim 3 wherein the three cylindrical portions comprise a third portion connected to the second portion and moveable relative to the first portion and the second portion.

5. The safety anchor as recited in claim 4 wherein the first portion has a first diameter, the second portion has a second diameter, and the third portion has a third diameter, and the first diameter is greater than the second diameter, and the second diameter is greater than the third diameter.

6. The safety anchor as recited in claim 1 wherein the stem is an elongated rod.

7. The safety anchor as recited in claim 1 wherein the stem includes an external thread.

8. The safety anchor as recited in claim 7 wherein the elastic member includes an internal thread, and the internal thread engages the enteral thread of the stem.

9. The safety anchor as recited in claim 1 wherein the elastic member is compressed between two flat discs to increase the diameter of the elastic member.

10. The safety anchor as recited in claim 9, wherein one of the two of the flat discs is fixed to a bottom of the stem and the other of the two flat discs is unfixed to the stem, and a handle is turned to move the one of the two of the flat discs towards the other of the two flat discs to compress the elastic member between the two flat discs.

11. The safety anchor as recited in claim 1 wherein a longitudinal axis of the stem is substantially parallel to a longitudinal axis of the portion.

12. The safety anchor as recited in claim 1 wherein the elastic member is compressible.

13. The safety anchor as recited in claim 1 wherein the elastic member is made of rubber.

14. A safety anchor removably attachable to a roof of a building, the safety anchor comprising:

a portion receivable in a drain line of a roof, wherein the portion comprises a first portion, a second portion connected to the first portion, and a third portion connected to the second portion, wherein the first portion and the second portion are moveable relative to each other and the third portion is moveable relative to the first portion and the second portion, and at least one of the first portion and the second portion is receivable in the drain line of the roof, and wherein the first portion has a first diameter, the second portion has a second diameter, and the third portion has a third diameter, and the first diameter is greater than the second diameter, and the second diameter is greater than the third diameter;

a stem received in an opening of the portion; and an elastic member attached to the stem, the elastic member having an adjustable diameter, wherein the diameter of the elastic member is increased to contact walls of the drain line to secure the safety anchor to the roof, wherein the first portion has a cylindrical body having the first diameter, an outwardly extending projection that extends outwardly from a circumference of a top surface of the cylindrical body having a first outer diameter, an inwardly extending projection that extends inwardly from the top surface of the cylindrical body to define an upper opening, and an inwardly extending projection that extends inwardly from a bottom surface of the cylindrical body to define a lower opening having a first inner diameter, wherein the second portion has a cylindrical body having the second diameter, an outwardly extending projection that extends outwardly from a circumference of a top surface of the cylindrical body having a second outer diameter, an inwardly extending projection that extends inwardly from the top surface of the cylindrical body to define an upper opening, and an inwardly extending projection that extends inwardly from a bottom surface of the cylindrical body to define a lower opening having a second inner diameter, wherein the third portion has a cylindrical body having the third diameter, an outwardly extending projection that extends outwardly from a circumference of a top surface of the cylindrical body having a third outer diameter, an inwardly extending projection that extends inwardly from the top surface of the cylindrical body to define an upper opening, and an inwardly extending projection that extends inwardly from a bottom surface of the cylindrical body to define a lower opening having a third inner diameter, wherein, the outwardly extending projection of the third portion is received within the cylindrical body of the second portion, and the outwardly extending projection of the second portion is received within the cylindrical body of the first portion.

15. The safety anchor as recited in claim 14 wherein the second outer diameter of the outwardly extending projection of the second portion is greater than the first inner diameter of the lower opening of the first portion, and the third outer diameter of the outwardly extending projection of the third portion is greater than the second inner diameter of the lower opening of the second portion.

16. The safety anchor as recited in claim 15 wherein, when the drain line has a diameter slightly larger than the first diameter, the outwardly extending projection of the first portion retains the first portion in the drain line and the second portion and the third portion are in an expanded position due to gravity, wherein, when the drain line has a diameter slightly larger than the second diameter, the outwardly extending projection of the second portion retains the second portion in the drain line and the second portion and the third portion are in the expanded position due to gravity, and wherein, when the drain line has a diameter slightly larger than the third diameter, the outwardly extending projection of the third portion retains the third portion in the drain line and a portion of the second portion is received inside the first portion.

17. The safety anchor as recited in claim 14 including a pipe received through the openings, the pipe including a cylindrical body and an outwardly extending projection that extends around an upper circumference of an upper end of the cylindrical body to define an opening, and the cylindrical body includes a lower end defining an opening, and the cylindrical body is received in the openings of the first portion, the second portion and the third portion.

18. The safety anchor as recited in claim 17 wherein the stem includes a threaded portion and a carry bar including two threaded projections attached to an upper end of the threaded portion, wherein the threaded portion is received in the pipe.

19. The safety anchor as recited in claim 18 wherein the elastic member includes a first rubber gasket, a second rubber gasket, and a third rubber gasket each including an annular projection around a center portion, each being internally threaded and removably connectable to a bottom end of the threaded portion, wherein one of the rubber gaskets is attachable to a bottom of the threaded portion, and the other two rubber gaskets are each attachable to one of threaded projections of the carry bar.

20. The safety anchor as recited in claim 19 wherein the rubber gasket located on the bottom end of the threaded portion is located between two discs, a top disc is biased towards the rubber gasket by a resilient member and unconnected to the threaded portion, a bottom disc is fixed to a bottom end of the threaded portion, and a handle is rotated to compress the rubber gasket between the top disc and the bottom disc to expand a diameter of the rubber gasket and retain the rubber gasket in the drain line.

21. A safety anchor removably attachable to a roof of a building, the safety anchor comprising:

a first portion connected to a second portion, and a third portion connected to the second portion, wherein the first portion, the second portion and the third portion are moveable relative to each other, and at least one of the first portion, the second portion, and the third portion are receivable in a drain line of a roof, wherein the first portion has a first diameter, the second portion has a second diameter, and the third portion has a third diameter, and the first diameter is greater than the second diameter, and the second diameter is greater than the third diameter, a pipe including a cylindrical body and an outwardly extending projection that extends around an upper circumference of an upper end of the cylindrical body to define an opening, and the cylindrical body includes a lower end defining an opening, and the cylindrical body is received in the openings of the first portion, the second portion and the third portion;

a threaded stem and a carry bar including two threaded projections attached to an upper end of the threaded stem, wherein the threaded stem is received in the pipe; and an elastic member attached to the threaded stem, the elastic member having an adjustable diameter, wherein the diameter of the elastic member is increased to contact walls of the drain line to secure the safety anchor to the roof.

22. The safety anchor as recited in claim 21, wherein the first portion has a cylindrical body having the first diameter, an outwardly extending projection that extends outwardly from a circumference of a top surface of the cylindrical body having a first outer diameter, an inwardly extending projection that extends inwardly from the top surface of the cylindrical body to define an upper opening, and an inwardly extending projection that extends inwardly from a bottom surface of the cylindrical body to define a lower opening having a first inner diameter, wherein the second portion has a cylindrical body having the second diameter, an outwardly extending projection that extends outwardly from a circumference of a top surface of the cylindrical body having a second outer diameter, an inwardly extending projection that extends inwardly from the top surface of the cylindrical body to define an upper opening, and an inwardly extending projection that extends inwardly from a bottom surface of the cylindrical body to define a lower opening having a second inner diameter, wherein the third portion has a cylindrical body having the third diameter, an outwardly extending projection that extends outwardly from a circumference of a top surface of the cylindrical body having a third outer diameter, an inwardly extending projection that extends inwardly from the top surface of the cylindrical body to define an upper opening, and an inwardly extending projection that extends inwardly from a bottom surface of the cylindrical body to define a lower opening having a third inner diameter, wherein the outwardly extending projection of the third portion is received within the cylindrical body of the second portion, and the outwardly extending projection of the second portion is received within the cylindrical body of the first portion.

23. The safety anchor as recited in claim 22 wherein the second outer diameter of the outwardly extending projection of the second portion is greater than the first inner diameter of the lower opening of the first portion, and the third outer diameter of the outwardly extending projection of the third portion is greater than the second inner diameter of the lower opening of the second portion.

24. The safety anchor as recited in claim 23 wherein, when the drain line has a diameter slightly larger than the first diameter, the outwardly extending projection of the first portion retains the first portion in the drain line, and the second portion and the third portion are in an expanded position due to gravity, wherein, when the drain line has a diameter slightly larger than the second diameter, the outwardly extending projection of the second portion retains the second portion in the drain line, and the second portion and the third portion are in the expanded position due to gravity, and wherein, when the drain line has a diameter slightly larger than the third diameter, the outwardly extending projection of the third portion retains the third portion in the drain line, and a portion of the second portion is received inside the first portion.

25. The safety anchor as recited in claim 24 wherein the elastic member includes a first rubber gasket, a second rubber gasket, and a third rubber gasket each including an annular projection around a center portion, each being internally threaded and removably connectable to a bottom end of the threaded stem, wherein one of the rubber gaskets is attachable to a bottom of the threaded stem, and the other two rubber gaskets are each attachable to one of threaded projections of the carry bar.

26. The safety anchor as recited in claim 25 wherein the rubber gasket located on the bottom end of the threaded stem is located between two discs, a top disc is biased towards the rubber gasket by a resilient member and unconnected to the threaded stem, a bottom disc is fixed to a bottom end of the threaded stem, and a handle is rotated to compress the rubber gasket between the top disc and the bottom disc to expand a diameter of the rubber gasket and retain the rubber gasket in the drain line.

27. The safety anchor as recited in claim 21 including a lanyard, wherein one end of a lanyard is connected to the safety anchor and an opposing end of the lanyard is attached to a harness to be worn by a worker.

* * * * *